US009872559B2

(12) United States Patent
Park

(10) Patent No.: US 9,872,559 B2
(45) Date of Patent: Jan. 23, 2018

(54) WIRE-REELING TYPE DESK

(71) Applicant: Kwankyu Park, Seoul (KR)

(72) Inventor: Kwankyu Park, Seoul (KR)

(73) Assignee: Kwankyu Park (KR)

( * ) Notice: Subject to any disclaimer, the term of this patent is extended or adjusted under 35 U.S.C. 154(b) by 0 days.

(21) Appl. No.: 15/080,934

(22) Filed: Mar. 25, 2016

(65) Prior Publication Data

US 2017/0143113 A1 May 25, 2017

Related U.S. Application Data

(63) Continuation of application No. PCT/KR2016/000285, filed on Jan. 12, 2016.

(30) Foreign Application Priority Data

Nov. 24, 2015 (KR) ..... 10-2015-0165108

(51) Int. Cl.
*A47B 21/06* (2006.01)
*A47B 97/00* (2006.01)

(52) U.S. Cl.
CPC ..... *A47B 21/06* (2013.01); *A47B 2021/066* (2013.01); *A47B 2097/003* (2013.01)

(58) Field of Classification Search
CPC ... A47B 21/06; A47B 21/00; A47B 2021/062; A47B 2021/066; A47B 2021/068
See application file for complete search history.

(56) References Cited

U.S. PATENT DOCUMENTS 8,960,584 B1 * 2/2015 Fearon ..... B65H 75/285 242/400.1
2002/0074460 A1 * 6/2002 Behar ..... A47B 21/06 248/51
2006/0278794 A1 * 12/2006 Rast ..... A47B 21/06 248/346.01
2007/0123095 A1 * 5/2007 Hybiske ..... A47B 21/06 439/501
2008/0224582 A1 * 9/2008 Boland ..... A47B 21/06 312/330.1
2009/0310291 A1 * 12/2009 Willburn ..... A47B 21/00 361/679.22
2012/0097418 A1 * 4/2012 Ruotsala ..... A47B 21/06 174/60
2013/0061783 A1 * 3/2013 Bennie ..... A47B 21/06 108/25
2015/0282612 A1 * 10/2015 Rutz ..... A47B 21/06 108/26

(Continued)

FOREIGN PATENT DOCUMENTS

KR 200207300 12/2000
KR 200210147 1/2001

(Continued)

*Primary Examiner* — Daniel J Rohrhoff
(74) *Attorney, Agent, or Firm* — Cantor Colburn LLP

(57) ABSTRACT

Provided is a desk for electric products. Particularly, the desk for electric products includes a power supply, a wire-reeling part, and a cover part for covering the power supply and the wire-reeling part. Thus, wires are neatly arranged on the wire-reeling part so as not to drag on the floor, thereby allowing the floor cleaning to be easily performed. Also, wires wound on the wire-reeling part are covered, thereby improving the exterior of the desk.

3 Claims, 20 Drawing Sheets

(56) References Cited

U.S. PATENT DOCUMENTS

2016/0120304 A1* 5/2016 McGowan ..... A47B 21/06
108/48

FOREIGN PATENT DOCUMENTS

| | | |
|---|---|---|
| KR | 200384336 | 5/2005 |
| KR | 1020110002931 | 1/2011 |
| KR | 2020110006775 | 7/2011 |

* cited by examiner

WIRE-REELING TYPE DESK

TECHNICAL FIELD

The following disclosure relates to a wire-reeling type desk, and more particularly, to a wire-reeling type desk which can neatly arrange electric lines and allow electric line not to drag on the floor, thereby facilitating the floor cleaning.

BACKGROUND ART

Due to the internet development and the diversification of job and hobby, users who use multiple-taps to plug in various peripherals or electric products in addition to a computer on one desk are increasing.

When many electric products are used connected to a multiple-tap, too many wires such as power lines, data transmission lines, and video/sound lines may drag on the floor, and may also cause wires to be contaminated, giving an unpleasant feeling in regard to the exterior. In addition, when a user cleans the floor with a vacuum cleaner, a broom or a mop, it may be difficult for a user to lift bundles of wires according to the condition of the wires that are twisted or fixed. In this case, the situation in which a user cannot appropriately clean the floor may be repeated, directly or indirectly causing hygienic limitations that lead to respiratory diseases and incurring the danger of electric shock when a user performs cleaning using water.

These limitations are inevitable because multiple-taps and desks are separately manufactured and distributed and because an optimal distance for an individual user between a desk and a multiple-tap cannot be predicted at the production stage.

In order to cover these limitations, various attempts to place wires and a multiple-tap in a storage box or attach a multiple-tap and a device for arranging wires to the desk are being conducted, but they are showing functional limitations in that it is still difficult to completely prevent dragging of many wires on the floor only with easy handwork by a user without a high degree of device configuration or an excessive change of the desk design.

SUMMARY OF THE INVENTION

Accordingly, the present disclosure provides a desk having a wire arrangement function such that wires do not drag on the floor under the desk, which allows a user to easily arrange many wires without a separate work and to easily clean the floor by fixing wires to the desk such that wires do not drag on the floor, thereby preventing respiratory infections and electric shock accidents, alleviating an unpleasant feeling in regard to the exterior of the desk through the arrange wires, and improving the quality of user's life by providing convenience of installation and arrangement only with a minimal wire-reeling work.

In one general aspect, a wire-reeling type desk includes: a wire-reeling part coupled to a desk structure and allowing a wire to be wound and arranged thereon; and a power supply coupled to the desk structure and supplying power, wherein the wire is wound and arranged on the wire-reeling part.

In this case, the wire-reeling part may include at least one protrusion rod having a straight-line or curved shape and protruding from any one point of the desk structure such at a top plate, a side plate, a rear plate, and a desk leg by a certain distance such that a wire is wound on the protrusion rod.

Also, at least one protrusion rod may be provided so as to be spaced from each other by a certain distance.

Also, the protrusion rod may include protrusions formed on the outer surface of the protrusion rod at a certain interval such that wires wound on the protrusion rod are not separated from the protrusion rod and are maintained at a wound state.

Also, the protrusion rod may include an end extending from the end portion thereof and bent at the end portion thereof such that wires wound on the protrusion rod are not separated from the protrusion rod.

Also, the protrusion rod may include an end which is a sculpture larger than the thickness of the protrusion rod such that wires wound on the protrusion rod are not separated from the protrusion rod.

The wire-reeling part may include at least one connection rod connecting two points of the desk structure which are spaced from each other by a certain distance.

The wire-reeling type desk may include a support rod protruding from two points of the desk structure.

Here, the connection rod having a straight-line or curved shape may be coupled to the end portions of the support rod such that wires are wound on the connection rod.

In this case, the connection rod may include protrusions formed on the outer surface of the connection rod at a certain interval such that wires wound on the connection rod are fixed without moving.

The wire-reeling part may include a frame constituting an edge and a frame bar having both end portions thereof connected to the frame inside the frame, and the frame may be inserted and fixed in a hole formed in a form of frame inside the desk structure.

In this case, the frame bars may be arranged in a vertical, horizontal, or both vertical and horizontal directions such that wire are wound in various forms.

Also, the frame bar may be formed in a curved shape.

Also, the frame bar may include protrusions formed on the outer surface of the frame bar at a certain interval such that wires are fixed while being wound.

The power supply may include: a fixing frame having one side thereof opened and the other side thereof on which a stopper is formed, the fixing frame being coupled to the desk structure; and a multiple-tap detachably inserted into the fixing frame through the opened side of the fixing frame, thereby making it easy to replace or repair a multiple-tap.

The wire-reeling type desk may further include a cover part coupled to the desk structure and selectively covering the wire-reeling part and the power supply which are formed on the desk structure, thereby improving the exterior of the desk.

The cover part may include a cover having a plate shape and having one side thereof coupled to a cover supporting member protruding from the desk structure by a hinge, and the cover may be configured into an openable/closable type so as to selectively cover the wire-reeling part and the power supply while pivoting on the hinge.

The wire-reeling type desk may include a cover supporting rod protruding from the desk structure.

Here, when the cover is closed, the other side of the cover may make contact with the cover supporting rod such that a certain gap is maintained between the cover and the desk structure.

The wire-reeling part may include a certain number of protrusion rods protruding from the desk structure and allowing a wire to be wound thereon, and when the cover is closed, the cover may make contact with the protrusion rods such that a certain gap is maintained between the cover and the desk structure.

The cover part may include: a rod protruding from any one of the desk structure or the cover; and a coupling member formed in the other of the desk structure or the cover and having a rod insertion hole.

Also, the cover may be configured into an attachable/detachable type such that the rod is inserted into the rod insertion hole of the coupling member and thus the cover selectively covers the wire-reeling part and the power supply.

The cover part may include a protrusion rod formed on the desk structure to allow a wire to be wound and arranged thereon and substituting for the wire-reeling part.

Also, the cover may be configured into an attachable/detachable type in which the a coupling member has a rod insertion hole into which the protrusion rod is inserted and the protrusion rod is inserted and fixed in the rod insertion hole of the cover to fix the cover.

In this case, the protrusion rod may include protrusions formed on the outer surface of the protrusion rod at a certain interval such that wires wound on the protrusion rod are not moved.

Other features and aspects will be apparent from the following detailed description, the drawings, and the claims.

In wire-reeling type desks according to the embodiments of the present invention, many wires can be easily arranged and fixed through wire arrangement units which are disposed on a desk without a separate tool or device. Thus, wires do not drag on the floor, and the floor cleaning can be easily performed, thereby preventing respiratory diseases and electric shock accidents.

Also, since wires can be neatly arranged through the wire arrangement on a desk, the exterior of a desk can be cleanly maintained. When a user repeats arrangement and disassembling of bundles of wires for replacement or structural change of electric products, rearrangement can be easily and quickly performed due to opened installation location and simply instruction. Also, non-power lines (e.g., monitor lines and speaker lines) as well as power lines can be conveniently collected and arranged.

Figure 1:
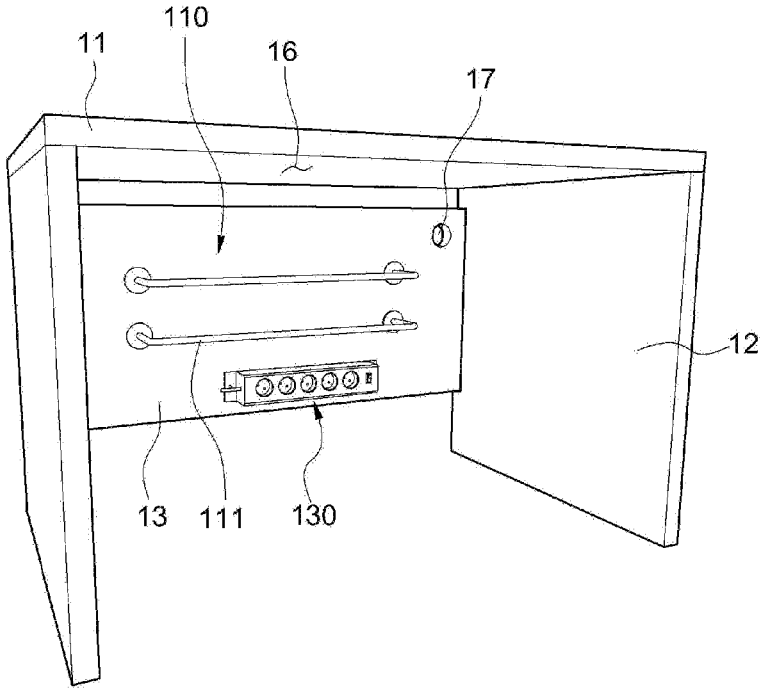
FIG. 1 is a perspective view illustrating a desk including a rear plate on which a wire-reeling part is disposed.

Reference numerals set forth in the Drawings includes reference to the following elements as further discussed below:

| | |
|---|---|
| 10: desk structure | 11: top plate |
| 12: side plate | 13: rear plate |
| 14: desk leg | 15: leg supporting strut |
| 16: wire passing space | 17: wire passing hole |
| 110: wire-reeling part | 111: connection rod |
| 112: protrusion | 113: support rod |
| 114: protrusion rod | 115: protrusion |
| 116: end | 117: sculpture |
| 118: frame | 119: frame bar |
| 121: protrusion | |
| 130: power supply | 131: multiple-tap |
| 132: fixing frame | 133: stopper |
| 134: cord outlet | 135: latch |
| 140: cover part | 141: openable/closable cover |
| 142: attachable/detachable cover | 143: cover supporting rod |
| 144: cover supporting member | 145: hinge |
| 146: grip | 147: magnet |
| 148: rod | 149: coupling member |
| 151: rod insertion hole | 152: protrusion |

DETAILED DESCRIPTION OF THE INVENTION

Hereinafter, exemplary embodiments of the present invention will be described in detail with reference to the accompanying drawings. In order to clarify the present invention, a description irrelevant to the constitution of the present invention will be omitted, and in the drawings, like reference numerals refer to like elements throughout.

Since the terms "including", "comprising", and "having" can be construed as encompassing corresponding components unless specially described as opposite, it should be understood that they do not exclude other components but encompass other components. Unless defined otherwise, all technical and scientific terms have the same meanings as commonly understood by those skilled in the art to which the present invention belongs.

A wire-reeling type desk according to an embodiment of the present invention may include a wire-reeling part 110 for reeling a wire, a power supply 130 for supplying power, and a cover part 140 which is an additional component and covers the wire-reeling part 110 and the power supply 130.

Generally, a desk may include a top plate 11, a side plate 12, and a rear plate 13, or may include a top plate 11 and desk legs 14 supporting the top plate 11. The wire-reeling part 110, the power supply 130, and the cover part 140 may be disposed on any one of the above-mentioned structures of a desk.

Figure 2:
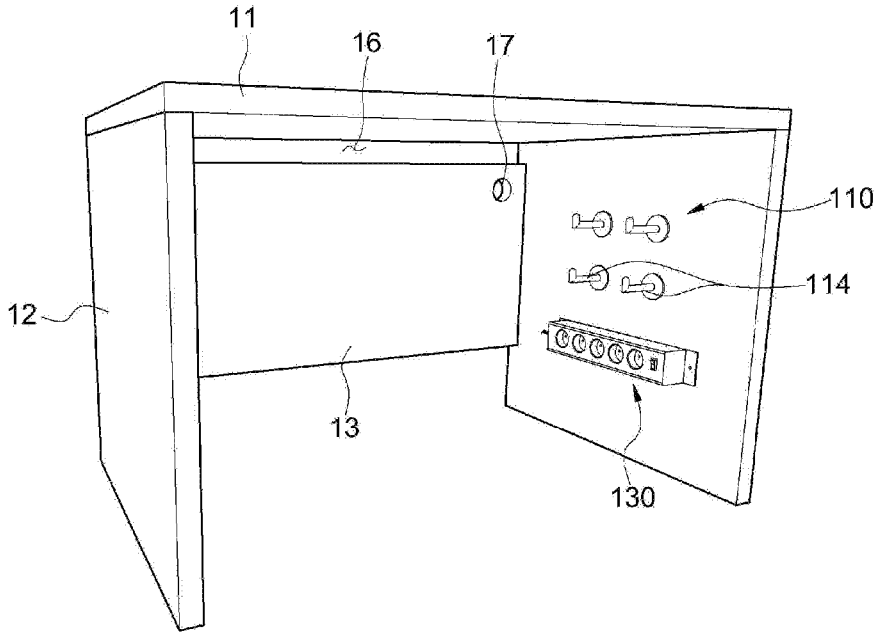
FIG. 2 is a perspective view illustrating a desk including a side plate on which a wire-reeling part is disposed.
Figure 3:
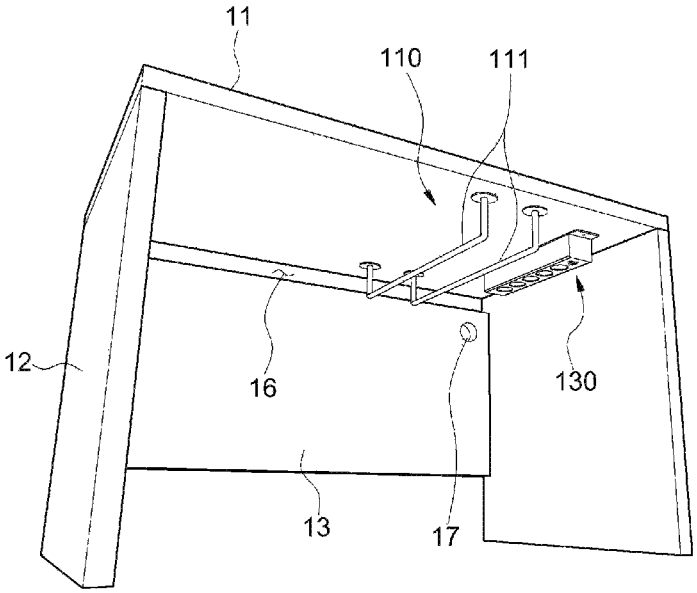
FIG. 3 is a perspective view illustrating a desk including a top plate under which a wire-reeling part is disposed.

As shown in FIG. 1, the wire-reeling part 110 and the power supply 130 may be disposed on the rear plate 13 of the desk, and as shown in FIG. 2, may be disposed on the side plate 12. Also, as shown in FIG. 3, the wire-reeling part 110 and the power supply 130 may be disposed on the undersurface of the top plate 11.

Figure 4:
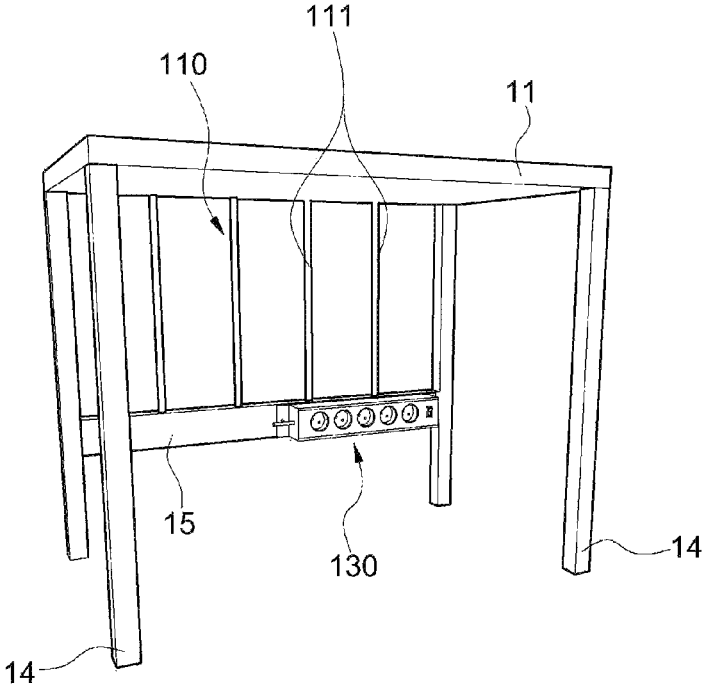
FIG. 4 is a perspective view illustrating a desk including a wire-reeling part connected to a desk leg supporting strut between desk legs.
Figure 5:
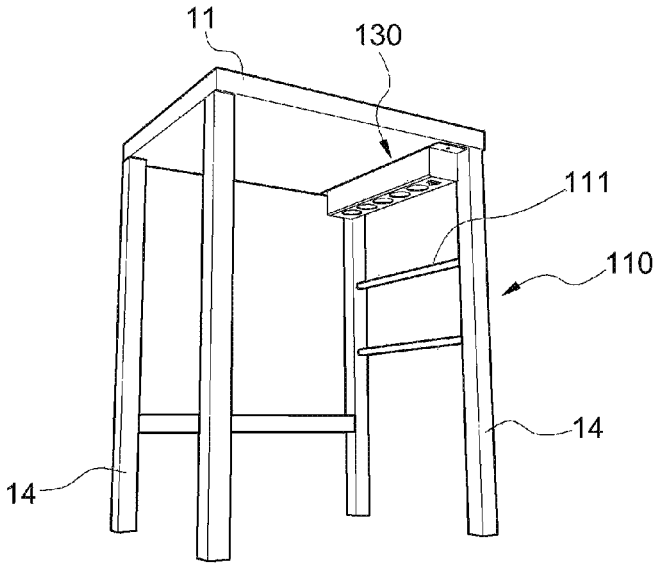
FIG. 5 is a perspective view illustrating a wire-reeling part disposed between desk legs.

In other implementations, as shown in FIG. 4, the wire-reeling part 110 may be disposed between the top plate 11 and a leg supporting strut 15 connecting and reinforcing desk legs 14, and as shown in FIG. 5, the wire-reeling part 110 may be disposed between the desk legs 14.

Hereinafter, the top plate 11, the side plate 12, the rear plate 13, the desk leg 14, and the leg supporting strut 15 of a desk will be collectively called a desk structure 10.

As described above, the wire-reeling part 110 which is disposed at various locations of the desk structure 10 and on which various kinds of wires are wound may be roughly divided into two types such as a connection rod 111 and a protrusion rod 114.

Figure 6:
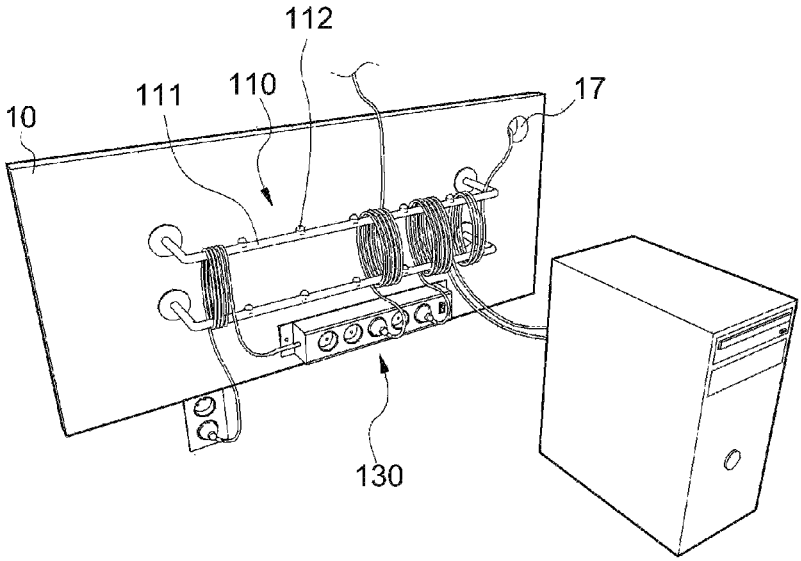
FIG. 6 is a view illustrating a use state of a wire-reeling part of a connection rod type.

As shown in FIGS. 1 and 3, the connection rod 111 may have a long bar shape connecting two points of the desk structure 10. As shown in FIG. 6, two or more connection rods 111 may be disposed so as to protrude from the desk structure 10. Thus, as shown in FIG. 6, wires of various electric products such as a computer may be cleanly wound on the connection rods 111, and thus can be maintained so as not to drag on the floor.

In this case, the wires may be configured to be withdrawn to the outside of a desk through a wire passing space 16 or a wire passing hole 17 which is formed in the desk structure 10.

Figure 7A:
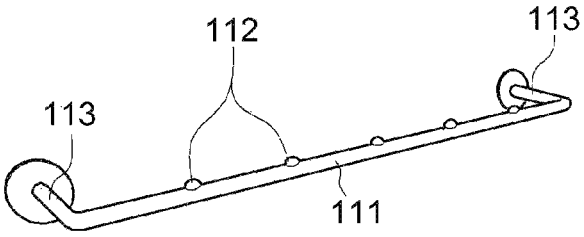
FIGS. 7A to 7D are views illustrating exemplary wire-reeling parts of a connection rod type.

The wire-reeling part 110 having a shape of the connection rod 111 may be configured into various forms. As shown in FIG. 7A, support rods 113 may protrude from two points of the desk structure 10, and the end portions of the connection rod 111 may be coupled to the support rods 113, allowing the connection rod 111 to be spaced from the desk structure 10.

In this case, protrusions 112 may be protrusively formed at a certain interval on the outer surface of the connection rod 111 such that wires wound on the connection rod 111 separately for each electric product cannot move sideways.

Figure 7B:
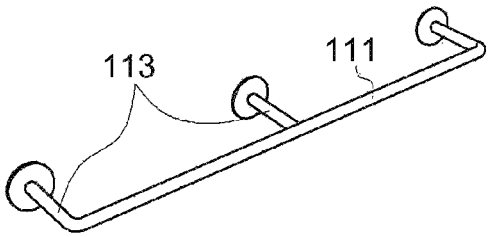

In another implementation, as shown in FIG. 7B, the support rods 113 may protrude from three points of the desk structure 10, and the central portion and the end portions of the connection rod 111 may be coupled to the support rods 113, allowing the connection rod 111 not to be bent when the connection rod 111 is long.

Figure 7C:
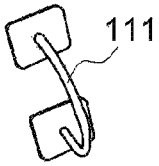

In another implementation, as shown in FIG. 7C, the connection rod 111 may be formed to have a curved shape instead of a straight-line shape, and the connection rod 111 having the curved shape may be coupled to two points of the desk structure 10.

Figure 7D:
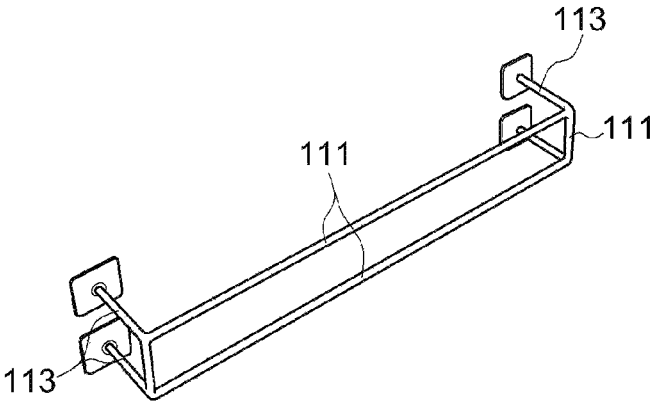

In another implementation, as shown in FIG. 7D, the support rod 113 may protrude from four points of the desk structure 10, and the both end portions of a certain number of connection rods 111 having a straight-line shape may be coupled to the support rods 113, respectively, thereby enabling configuration of various shapes of wire-reeling part 110.

Figure 8:
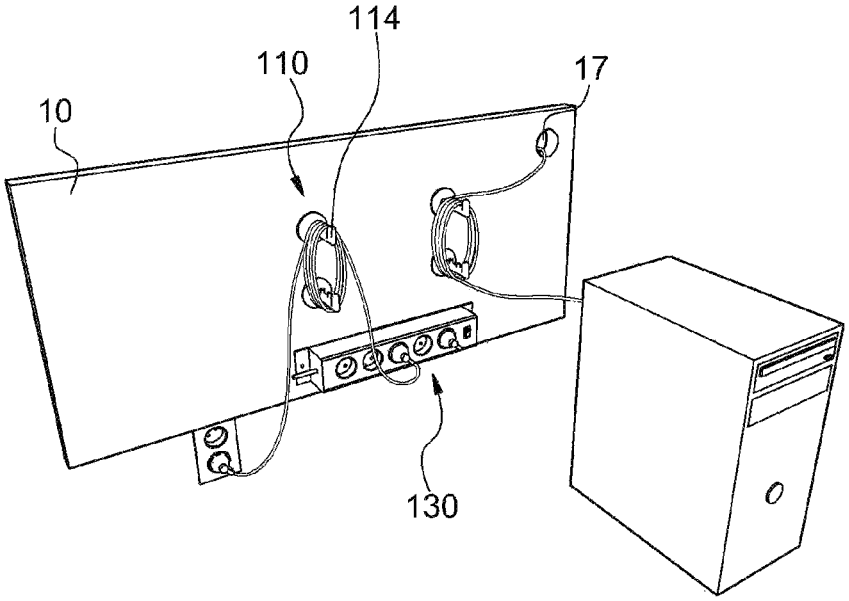
FIG. 8 is a view illustrating a use state of a wire-reeling part of a protrusion rod type.

On the other hand, the wire-reeling part 110 having a shape of the protrusion rod, as shown in FIGS. 2 and 8, may be configured such that a certain number of protrusion rods 114 protrude from the desk structure 10. As shown in FIG. 8, a wire of an electric product such as a computer may be wound and arranged on a pair of protrusion rods 114. In this case, when the thickness of the protrusion rod 114 is large, a wire may also be wound and arranged on only one protrusion rod 114.

Figure 9A:
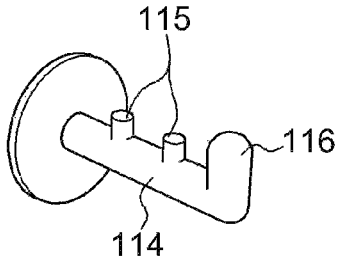
FIGS. 9A to 9D are views illustrating exemplary wire-reeling parts of a protrusion rod type.
Figure 9B:
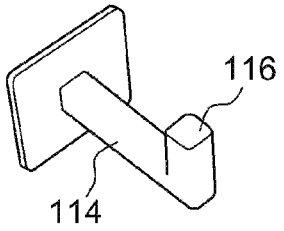

The protrusion rod 114 of the wire-reeling part 110 may protrude from the desk structure 10, and as shown in FIGS. 9A and 9B, the end portion of the protrusion rod 114 may be bent to form an end 116. Thus, a wire may not be separated from the protrusion rod while or after the wire is wound on the protrusion rod 114.

Figure 9C:
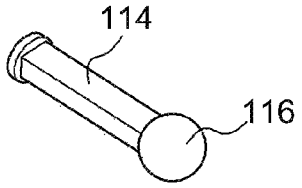
Figure 9D:
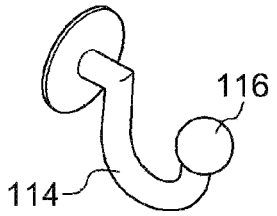
Figure 10:
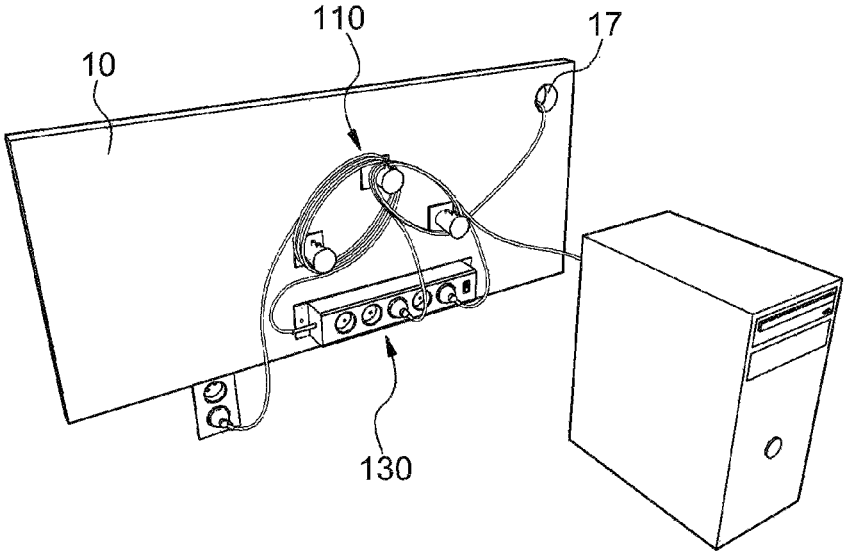
FIG. 10 is a view illustrating a use state of a wire-reeling part of a protrusion rod on which various shapes of sculptures are disposed.

In other implementations, as shown in FIGS. 9C and 9D, the end 116 may be configured to have a spherical shape such that a wire is not separated from the protrusion rod 114.

As shown in FIG. 9A, protrusions 115 may also be formed on the outer side of the protrusion rod 114 at a certain interval to allow a wire not to move on the protrusion rod 114, and as shown in FIG. 9D, the protrusion rod 114 may also be configured to have a curved shape as well as a straight-line shape.

The protrusion rod 114 may be configured into various three-dimensional shapes in addition to a pillar shape.

Figure 11A:
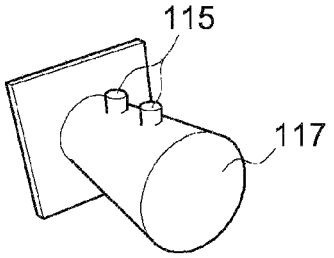
FIGS. 11A to 11D are views illustrating exemplary wire-reeling parts of a protrusion rod on which various shapes of sculptures are disposed.
Figure 11B:
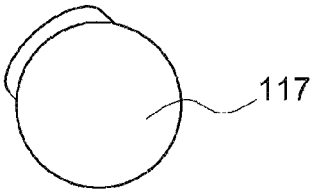
Figure 11C:
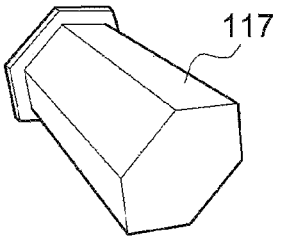
Figure 11D:
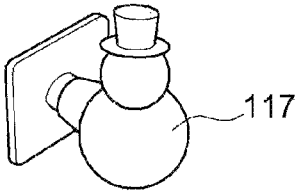

As shown in FIG. 11A, the wire-reeling part 110 having a shape of protrusion rod may be configured into a sculpture 117 having a conic shape which has protrusions 115 arranged at a certain interval thereon. As shown in FIG. 11B, the wire-reeling part 110 having a shape of protrusion rod may be configured into a sculpture 117 having a spherical shape. As shown in FIG. 11C, the wire-reeling part 110 having a shape of protrusion rod may be configured into a sculpture 117 having a hexagonal section. As shown in FIG. 11D, the wire-reeling part 110 having a shape of protrusion rod may be configured into a sculpture 117 having a snowman shape.

As described above, the wire-reeling parts 110 having shapes of the connection rod 111 and the protrusion rod 114 may be configured so as to protrude from the desk structure 10 such as the top plate 11, the side plate 12 or the rear plate 13. However, the wire-reeling part 114 may also be configured into a sash bar type so as not to protrude toward the inside of a desk.

Figure 12:
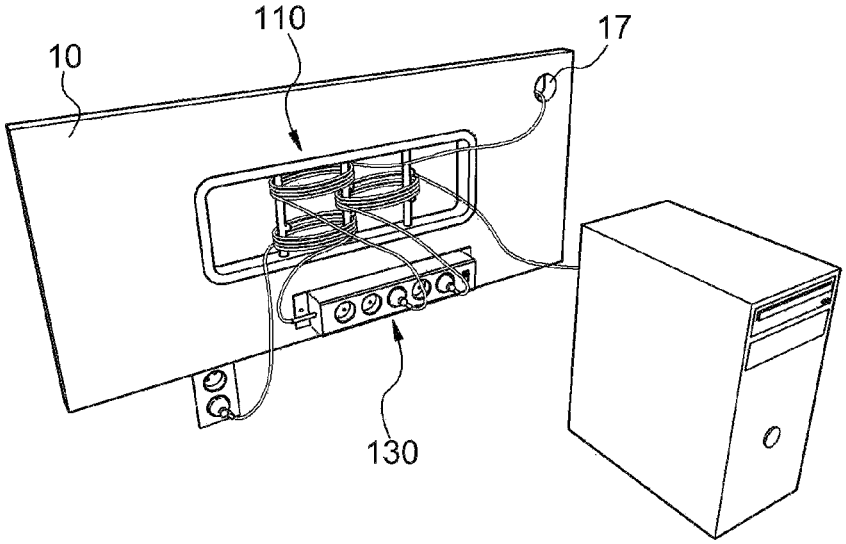
FIG. 12 is a view illustrating a use state of a wire-reeling part of a sash bar type.

As shown in FIG. 12, the wire-reeling part 110 of a sash bar type may be formed by cutting the side plate 12 or the rear plate 13 of a desk into shapes of frames 118 as shown in FIG. 13A to 13D and inserting the frames 118 into the cut holes.

Figure 13A:
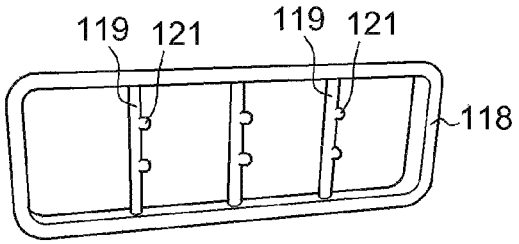
FIGS. 13A to 13D are views illustrating exemplary wire-reeling parts of a sash bar type.

In the wire-reeling part 110 shown in FIG. 13A, both end portions of a certain number of frame bars 119 having a straight-line shape may be fixedly coupled to the frames 118 facing each other such that the frame bars 119 are spaced from each other by a certain distance. Thus, as shown in FIG. 12, wires of electric products such as a computer may be wound and arranged on the frame bars 119 inside the frame 118.

In this case, protrusions 121 may be formed on the frame bar 119 of the sash bar type wire-reeling part 110 at a certain interval, allowing wires wound on the frame bars 119 to be fixed without drooping.

Figure 13B:
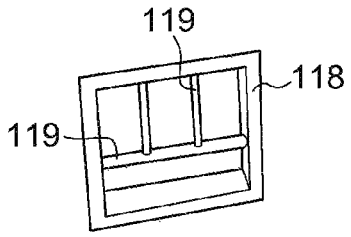
Figure 13C:
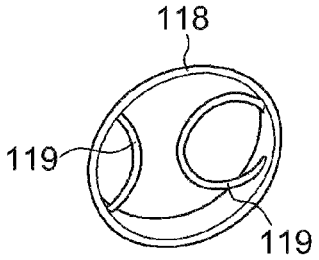
Figure 13D:
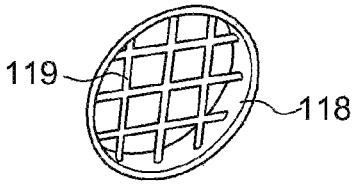
Figure 14:
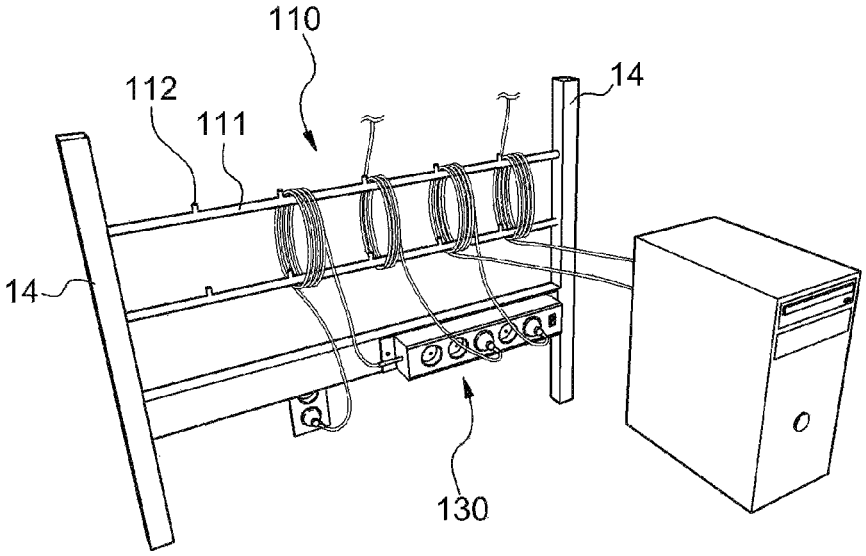
FIG. 14 is a view illustrating a use state of a wire-reeling part of a leg connection type.

The sash bar type wire-reeling part 110 may be configured into a combination of the frame bars 119 of horizontal and vertical shapes inside the rectangular frame 118 as shown in FIG. 13B, and may also be configured into a circular frame 118 which frame bars 119 having a curved shape are inserted into as shown in FIG. 13C. Also, the sash bar type wire-reeling part 110 may be configured into a circular frame 118 into which frame bars 119 having a mesh shape are inserted as shown in FIG. 13D.

The wire-reeling parts 110 of a connection rod type, a protrusion rod type, a sculpture shape, and a sash bar type may be implemented when a desk includes the top plate 11, the side plate 12, and the rear plate 13.

A desk may be configured with the top plate 11 and four desk legs 14 supporting the top plate 11. The desk including the top plate 11 and the four desk legs 14 may include a wire-reeling part 110 of a leg connection type as shown in FIGS. 4 and 5.

The leg connection type wire-reeling part 110 shown in FIG. 4 may be configured with the leg supporting strut 15 connecting two desk legs 14 and reinforcing the desk legs 14, and a certain number of connection rods 111 connecting the leg supporting strut 15 and the top plate 11 in a vertical direction may be disposed at a certain interval.

Wires of various electric products may be wound on the connection rods 111 disposed in a vertical direction, allowing the wires to be neatly kept without dragging on the floor.

Although not shown in the drawing, protrusions (not shown) may be formed on the outer side of the vertical connection rod 111 at a certain interval, allowing wires wound on the connection rod 111 to be fixed at the original wound location without drooping.

When a desk includes only the top plate 11 and four desk legs 14 without the leg supporting strut 15 connecting the desk legs 14 as shown in FIG. 4, the wire-reeling part 110 may include a certain number of horizontal connection rods 111 connecting the desk legs 14 as shown in FIG. 5. Thus, wires of electric products such as a computer may be wound and arranged on the connection rod 111 like in FIG. 4.

Figure 15A:
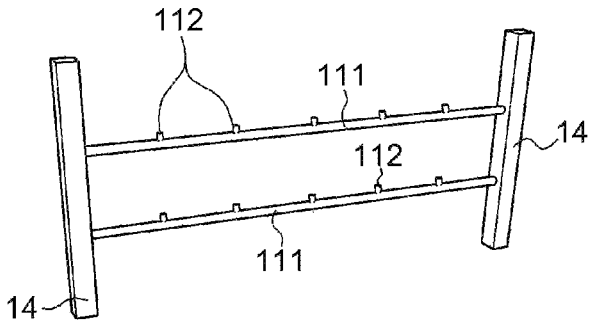
FIGS. 15A to 15D are views illustrating exemplary wire-reeling parts of a leg connection type.
Figure 15B:
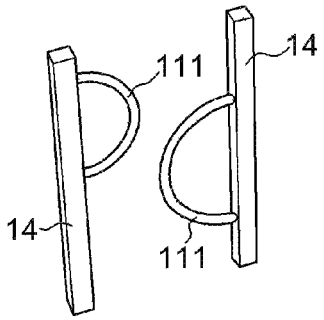

The leg connection type wire-reeling part 110 installed on the desk leg 14 may be configured into various forms. As shown in FIG. 15A, a connection rod 111 having protrusions 112 formed thereon at a certain interval may be formed in a straight-line shape, and both end portions of the connection rod 111 may be coupled to the desk legs 14. In another implementation, as shown in FIG. 15B, connection rods 111 having a curved shape may also be coupled to the desk legs 14, respectively, thereby allowing wires to be wound and arranged on the connection rod 111.

Figure 15C:
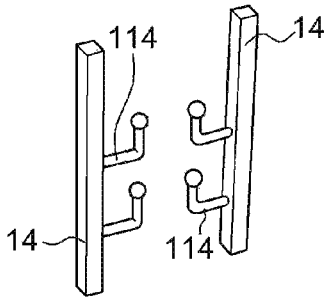

In another implementation, as shown in FIG. 15C, protrusion rods 114 may also be formed on the desk legs 14 to configure the wire-reeling part 110. In this case, as shown in FIG. 15C, the end portion of the protrusion rod 114 may be bent to allow wires to be wound in a vertical or horizontal direction.

Figure 15D:
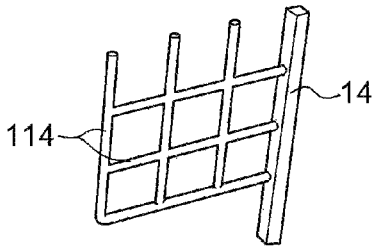

In another implementation, as shown in FIG. 15D, a wire-reeling part 110 of a mesh type may also be configured by forming a horizontal protrusion rod 114 on the desk leg 14 at a certain interval and then forming a vertical protrusion rod 114 on the horizontal protrusion rod 114 at a certain interval.

The wire-reeling type desk that makes the floor cleaning easier may include various types of wire-reeling part 110 disposed on the desk structure 10 such as the top plate 11, the side plate 12, the rear plate 13, and the desk leg 14, thereby allowing wires of various electric products used on a desk such as a computer, a monitor, and a desk lamp to be neatly wound and arranged on the wire-reeling part 110.

The power supply 130 for supplying power to various electric products used on a desk, as shown in FIGS. 1 to 5, may be located at a location adjacent to the wire-reeling part 110, and may generally include a multiple-tap 131 that can supply power to various electric products.

Figure 16:
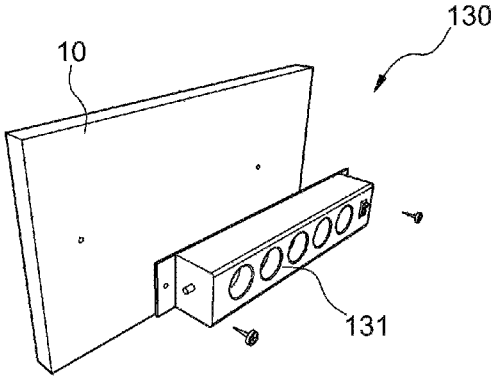
FIGS. 16 to 18 are views illustrating exemplary power supply coupling members installed on a desk.

As shown in FIG. 16, the power supply 130 may be configured by coupling the multiple-tap 131 to the desk structure 10 such as the top plate 11, the side plate 12, the rear plate 13, and the desk leg 14 by bolts or nails.

Figure 17:
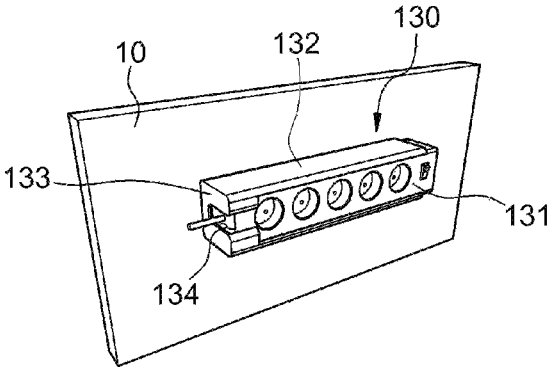

In another implementation, as shown in FIG. 17, a fixing frame 132 having a side surface and a portion of front surface thereof opened may be coupled to the desk structure 10, and the multiple-tap 131 may be inserted into and coupled to the fixing frame 132 through the opened side surface of the fixing frame 132.

In this case, a stopper 133 formed at the other side of the fixing frame 132 may allow the multiple-tap 131 to be fixed at an accurate location in the fixing frame 132, and the power line of the multiple-tap 131 may be withdrawn through a cord outlet 134 formed at the other side of the fixing frame 132. Also, the power cords of electric products may be plugged in the socket of the multiple-tap 131 exposed to the front surface to be supplied with power.

Figure 18:
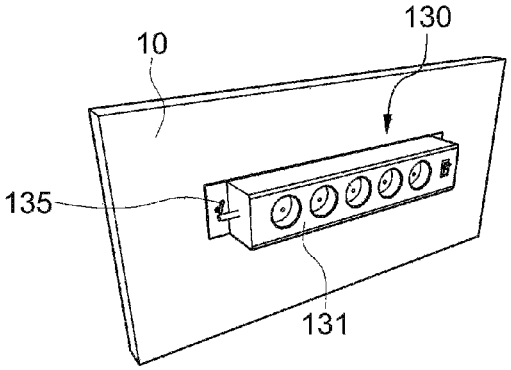

In another implementation, as shown in FIG. 18, a latch 13 may be formed on the desk structure 10. The power supply 130 may also be configured such that the latch 135 is inserted into a coupling hole (not referenced) formed in the multiple-tap 131.

As described above, when the wire-reeling part 110 and the power supply 130 are disposed on the desk structure 10 such as the top plate 11, the side plate 12, the rear plate 13, and the desk leg 14, wires may be exposed, and thus the exterior of a desk may look messy. Also, when a user is sitting on a chair, wires may be caught on his/her feet and thus may be unwound.

In order to overcome this limitation, the cover part 140 may be provided to cover the wire-reeling part 110 and the power supply 130 disposed on a desk.

Figure 19:
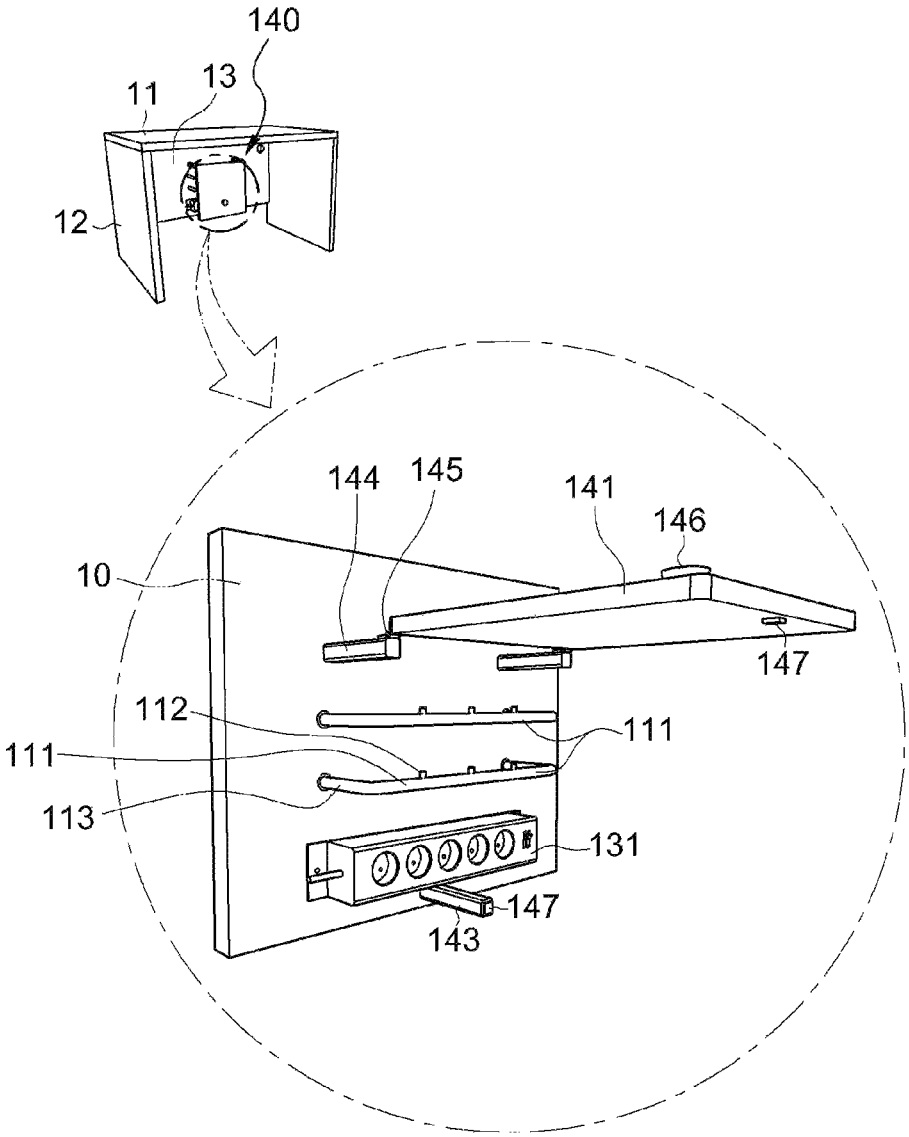
FIGS. 19 and 20 are views illustrating openable/closable cover parts disposed on wire-reeling parts.
Figure 20:
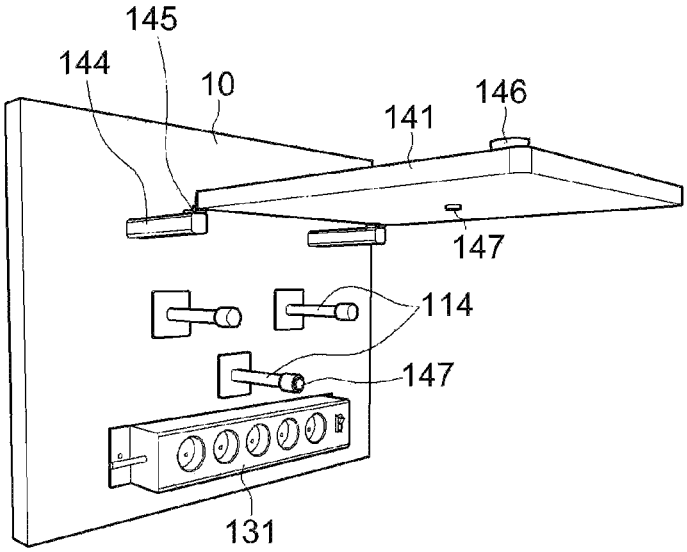

The cover part 140 may be configured into an openable/closable cover part shown in FIGS. 19 and 20 and an attachable/detachable cover part shown in FIGS. 21 to 26.

FIG. 19 shows an openable/closable cover part 140 according to an embodiment of the present invention.

As shown in FIG. 19, a pair of cover supporting members 144 spaced from each other by a certain distance may protrude from the desk structure 10 on which the wire-reeling part 110 and the power supply 130 are disposed, and the upper end of a openable/closable cover 141 having a plate shape and including a grip 146 may be coupled to the end portion of the cover supporting member 144 by a hinge.

When the openable/closable cover 141 of the cover part 140 opens, as shown in FIG. 19, the openable/closable cover 141 may pivot on the hinge 145 coupled to the cover supporting member 144 to be opened, and thus the wire-reeling part 110 and the power supply 130 covered by the openable/closable cover 141 may be exposed.

As shown in FIG. 19, the wire-reeling part 110 may include a pair of connection rods, and a cord may be plugged in the socket of the multiple-tap 131 and then a wire may be wound and arranged on the connection rod.

When a wire is wound and arranged on the wire-reeling part 110 and then the openable/closable cover 141 is closed, the openable/closable cover 141 may cover the wire-reeling part 110 and the multiple-tap 131 and allow the exterior of a desk to look clean. Also, when a user works sitting on a chair, his/her feet may not touch the wire.

A cover supporting rod 143 may be protrusively formed on the desk structure 10 at a location corresponding to the lower end portion of the openable/closable cover 141 when the openable/closable cover 141 is closed.

When the openable/closable cover 141 is closed, the lower end portion of the openable/closable cover 141 may make contact with the cover supporting rod 143, securing a space between the openable/closable cover 141 and the desk structure 10 and thus allowing wires wound on the wire-reeling part 110 and cords plugged in the socket of the multiple-tap not to be pressed by the openable/closable cover 141.

Also, magnets 147 may be disposed on the end portion of the cover supporting rod 143 and a portion of the cover 141 making contact with the cover supporting rod 143 such that the cover 141 is not opened due to a magnetic force when the cover 141 is closed.

FIG. 20 shows an openable/closable cover part 140 according to another embodiment of the present invention.

As shown in FIG. 20, the openable/closable cover part 140 according to another embodiment of the present invention may be configured such that the upper end of the cover 141 is coupled to the cover supporting member 144 protruding by a certain length by a hinge, allowing the wire-reeling part 110 and the multiple-tap 131 to be covered by the cover 141 when the cover 141 is closed.

In the openable/closable cover part 140 shown in FIG. 20, the wire-reeling part may be configured into a protrusion rod type. Unlike in FIG. 19, the cover supporting rod 143 for supporting the cover 141 when the cover 141 is covered may not be provided. Instead, the protrusion rods 114 may serve as the cover supporting rod 143, allowing the cover 141 to be spaced from the desk structure 10 by a certain distance when the cover 141 is closed.

In this case, a magnet 147 may be disposed on the end portion of any one of protrusion rods 114, and another magnet 147 may be disposed on a portion of the cover 141 corresponding thereto, such that the cover 141 is not opened due to a magnetic force when the cover 141 is closed.

Heretofore, the openable/closable cover part has been described, and hereinafter, the attachable/detachable cover part will be described.

Figure 21:
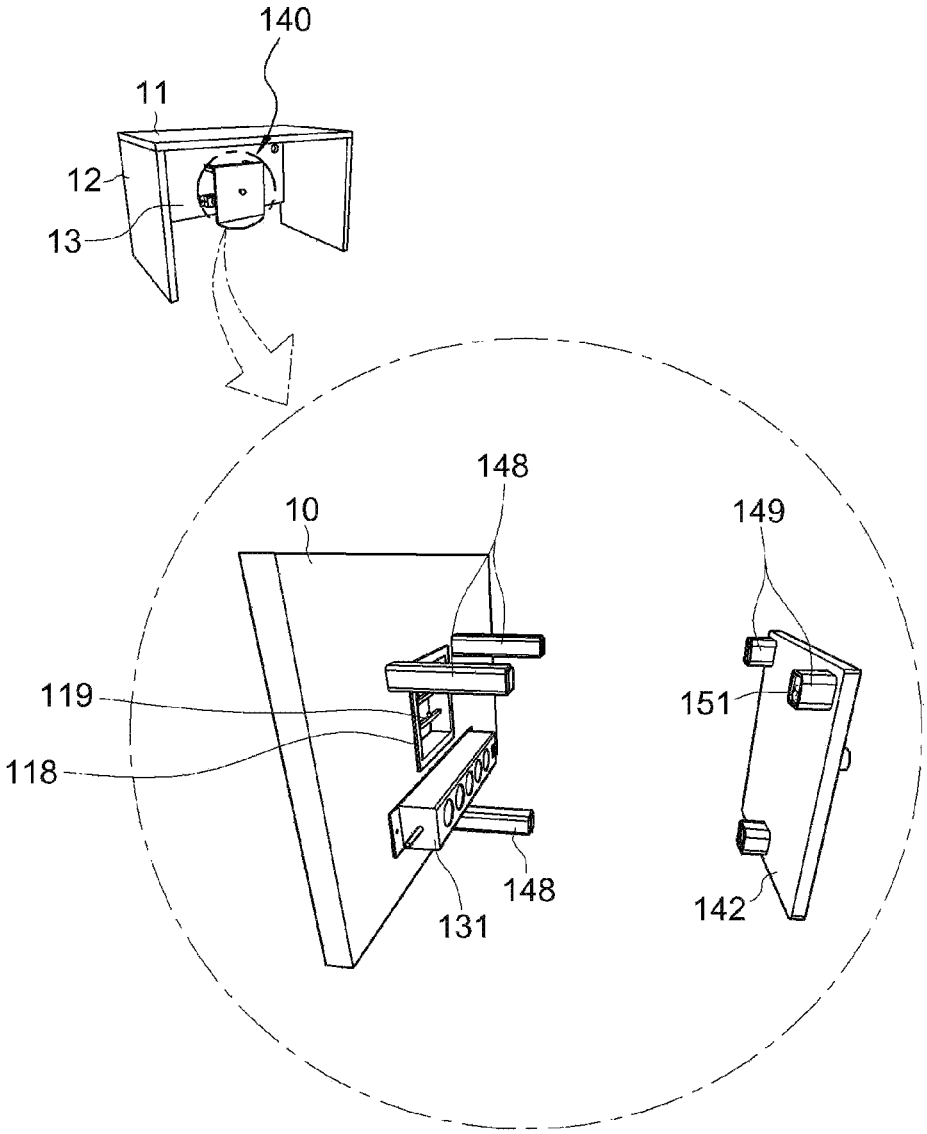
FIGS. 21 to 26 are views illustrating attachable/detachable cover parts disposed on wire-reeling parts.

FIG. 21 shows an attachable/detachable cover part according to an embodiment of the present invention.

In another implementation of the attachable/detachable cover part, as shown in FIG. 21, a wire-reeling part 110 and a multiple-tap 131 as a power supply may be disposed on the desk structure 10 such as the top plate 11, the side plate 12, the rear plate 13, and the desk leg 14. Also, a certain number of rods 148 may protrude from the desk structure 10.

Also, an attachable/detachable cover 142 having a plate shape in which a grip 146 is formed on one surface thereof and coupling members 149 are formed on the other surface thereof may be formed. The coupling member 149 of the attachable/detachable cover 142 may have a rod insertion hole 151. The rod 148 may be inserted and fixed in the rod insertion hole 151 of the coupling member 149 of the attachable/detachable cover 142 such that the attachable/detachable cover 142 covers the wire-reeling part 110 and the multiple-tap 131.

The wire-reeling part 110 of the attachable/detachable cover part shown in FIG. 21 may be a sash bar type wire-reeling part 110, where a cord is plugged in the socket of the multiple-tap 131 and a wire is wound and arranged on the sash bar type wire-reeling part 110 and then covered by the cover 142.

In this case, although not shown in the drawing, magnets (not shown) may be disposed on the end portion of the rod 148 and inside the rod insertion hole 151, such that the cover 142 is not opened due to a magnetic force when the cover 142 is closed.

Figure 22:
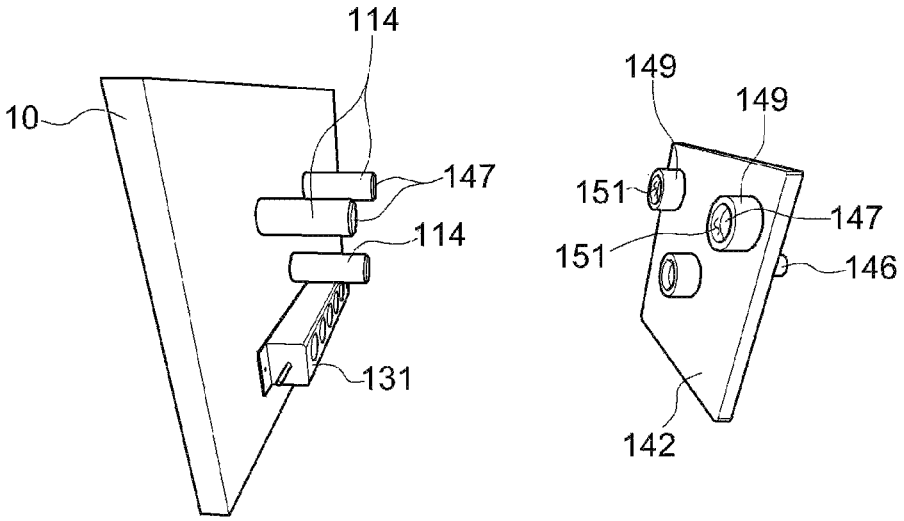

FIG. 22 shows an attachable/detachable cover part according to another embodiment of the present invention.

While the rod 148 protrudes to fix the cover 142 in the embodiment of FIG. 21, protrusion rods 114 as the wire-reeling part 110 may protrude from the desk structure 10 in another embodiment of FIG. 22, and the protrusion rod 114 may be inserted into the rod insertion hole 151 of the coupling member 149 of the cover 142 to fix the cover 142.

That is, the protrusion rod 114 that is the wire-reeling part 110 may serve to fix the cover 142 with a separate rod 148 for fixing the cover 142, and may simultaneously allow wires to be wound and arranged thereon.

A magnet 147 may be disposed on the end portion of the protrusion rod 114, and another magnet 147 may be disposed in the rod insertion hole 151 of the coupling member 149 such that the cover 142 is fixed by a magnetic force when the protrusion rod 114 is inserted into the rod insertion hole 151.

Figure 23:
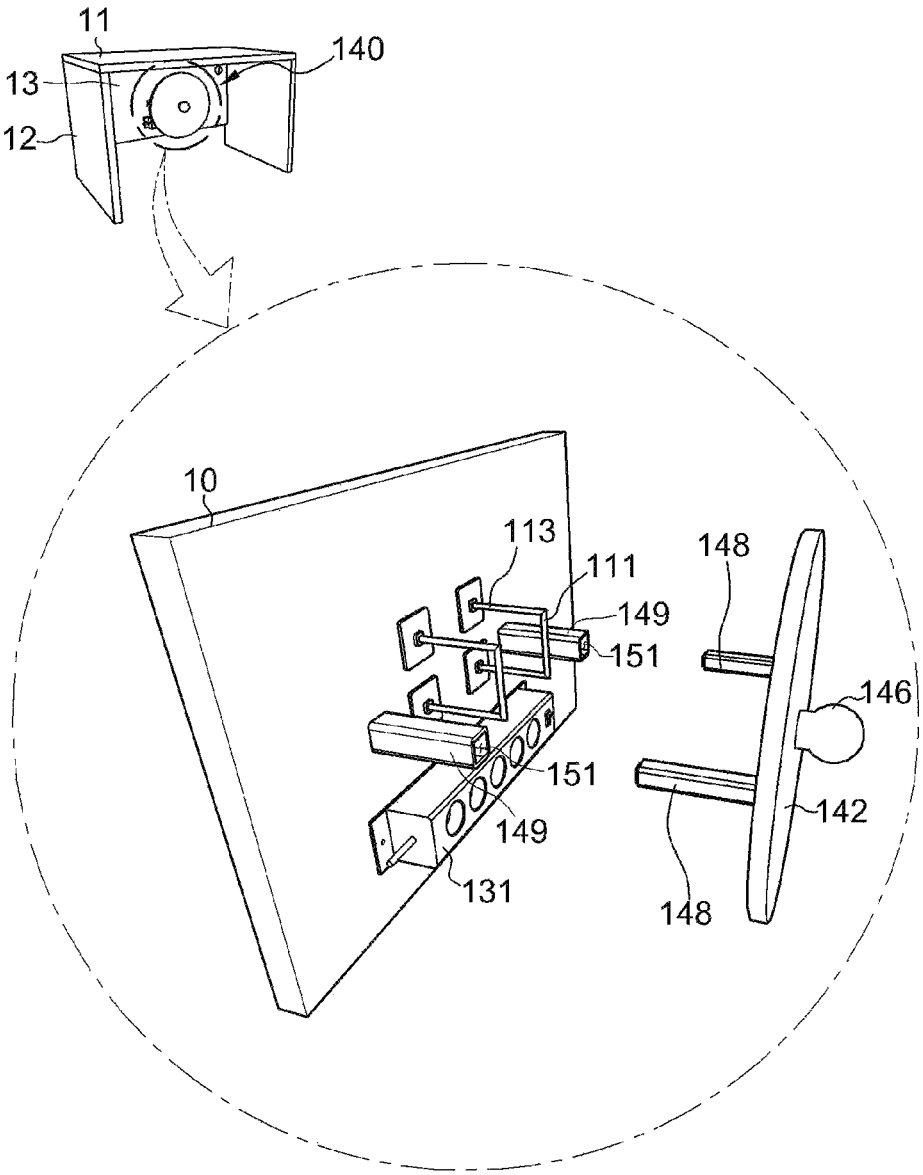
Figure 24:
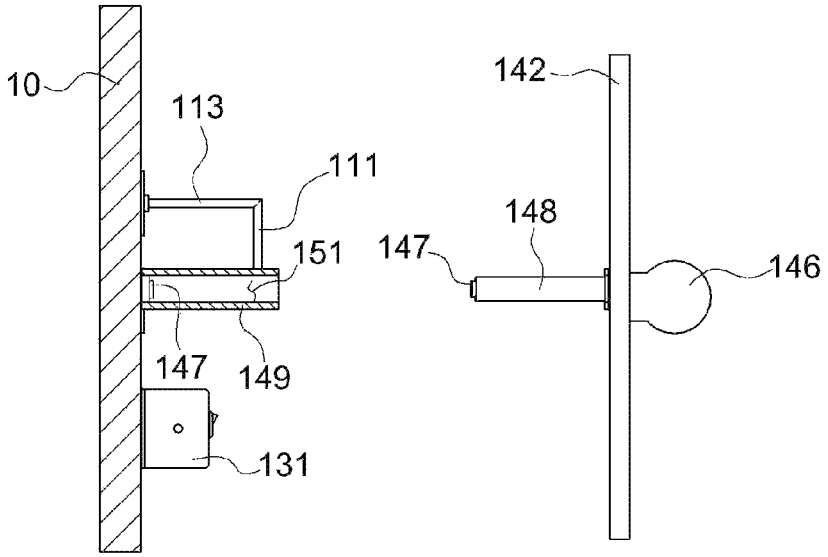

FIGS. 23 and 24 show an attachable/detachable cover part according to still another embodiment of the present invention.

In the embodiments shown in FIGS. 21 and 22, the rod 148 may be disposed on the desk structure 10, and the coupling member 149 with the rod insertion hole 151 may be disposed on the attachable/detachable cover 142 such that the rod 148 of the desk structure 10 is inserted into the rod insertion hole 151 of the coupling member 149 of the attachable/detachable cover 142. However, in the embodiments shown in FIG. 23, a coupling member 149 with a rod insertion hole 151 may be protrusively formed on the desk structure 10, and a rod 148 may be protrusively formed on the cover 142 such that the rod 148 of the cover 142 is inserted into the rod insertion hole 151 of the coupling member 149 of the desk structure 10.

In this case, as shown in FIG. 24, magnets 147 may be disposed inside the rod insertion hole 151 and on the end portion of the rod 148 such that the cover 142 is stably fixed by a magnetic force.

Figure 25:
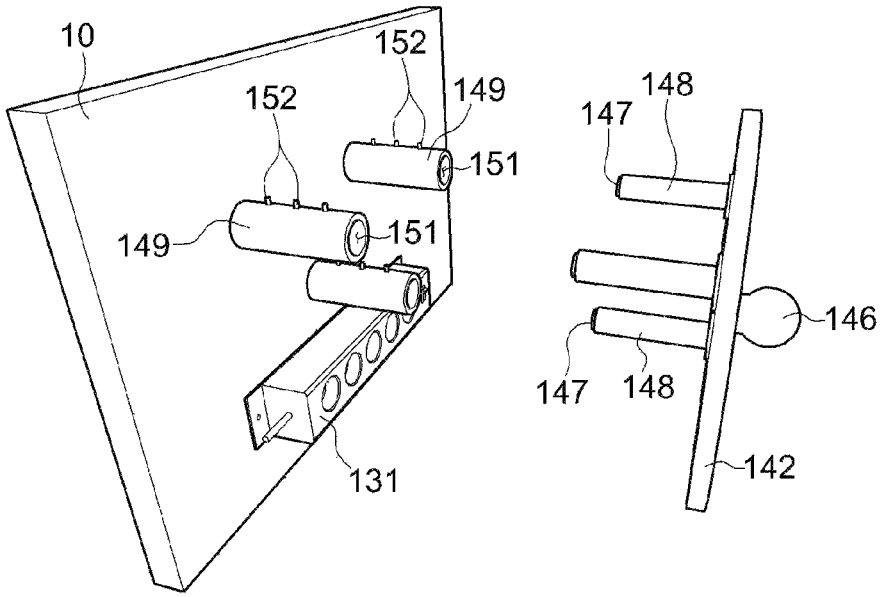
Figure 26:
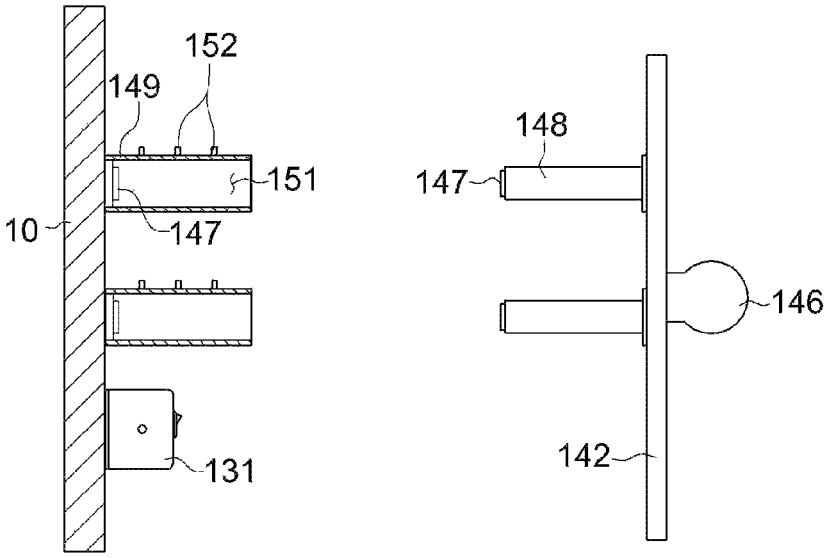

FIGS. 25 and 26 show an attachable/detachable cover part according to even still another embodiment of the present invention.

While a separate wire-reeling part 110 is provided in addition to the coupling member 149 in FIGS. 23 and 24, a coupling member 149 may be configured to be used as a coupling unit for the cover 142 as well as a wire-reeling part 110 in FIGS. 25 and 26.

In this case, protrusions 152 may be protrusively formed on the outer surface of the coupling member 149 such that wires wound on the coupling member 149 are not moved.

In the wire-reeling type desks according to the embodiments of the present invention, wires can be easily arranged and fixed through the wire-reeling part 110, the power supply 130, and the cover part 140 which are disposed on a desk. Thus, wires do not drag on the floor, and the floor cleaning can be easily performed, thereby preventing respiratory diseases and electric shock accidents.

Also, since wires can be neatly arranged through the wire arrangement on a desk, the exterior of a desk can be cleanly maintained. When a user repeats arrangement and disassembling of bundles of wires for replacement or structural change of electric products, rearrangement can be easily and quickly performed due to opened installation location and simply instruction. Also, non-power lines (e.g., monitor lines and speaker lines) as well as power lines can be conveniently collected and arranged.

The technical spirits of the present invention have been described through some embodiments above.

It will be clear that those skilled in the art can variously change or modify the above-mentioned embodiments from the described details of the present invention.

Also, although not described or shown in the drawing, it will be clear to those skilled in the art that the present invention can be modified into various forms including the technical spirit of the present invention from the described details of the present invention, which still belong to the scope of the present invention.

The invention claimed is:

1. A wire-reeling type desk comprising:

a wire-reeling part coupled to a desk structure and allowing a wire to be wound and arranged thereon;

a power supply coupled to the desk structure and supplying power; and a cover part coupled to the desk structure and selectively covering the wire-reeling part and the power supply which are formed on the desk structure, wherein the wire-reeling part comprises at least two connection rods each connecting end portions of two support rods protruding from two points of the desk structure, the at least two connection rods being parallel with each other and having a straight-line or curved shape, and the two support rods beings spaced from each other by a certain distance, wherein each of the at least two connection rods comprises protrusions formed on an outer surface thereof, the protrusions being formed at a certain interval between the end portions of two support rods, wherein the wire includes a plurality of wires, each of the wires is wound around the at least two parallel connection rods and between two neighboring protrusions, and the protrusions prevent the wound wires from being mixed up with adjacent wound wire, wherein the cover part comprises a cover having one side thereof coupled to a cover supporting member protruding from the desk structure by a hinge, and wherein when the cover part is closed, an inner side of the cover part makes contact with the cover supporting rod such that a certain gap is maintained between the cover part and the desk structure.

2. The wire-reeling type desk of claim 1, wherein the power supply comprises:

a fixing frame having one side thereof opened and the other side thereof on which a stopper is formed, the fixing frame being coupled to the desk structure; and a multiple-tap detachably inserted into the fixing frame through the opened side of the fixing frame.

3. The wire-reeling type desk of claim 1, wherein the cover part comprises a cover having a plate shape and having one side thereof coupled to a cover supporting member protruding from the desk structure by a hinge, and the cover is configured into an openable/closable type so as to selectively cover the wire-reeling part and the power supply while pivoting on the hinge.

* * * * *